US010184716B1

(12) United States Patent
Post et al.

(10) Patent No.: US 10,184,716 B1
(45) Date of Patent: Jan. 22, 2019

(54) DOOR AJAR DETECTION SYSTEM

(71) Applicant: WHIRLPOOL CORPORATION, Benton Harbor, MI (US)

(72) Inventors: Ryan M. Post, Coloma, MI (US); Michael S. Richards, St. Joseph, MI (US); Andrew M. Tenbarge, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/648,299

(22) Filed: Jul. 12, 2017

(51) Int. Cl.
*F25D 29/00* (2006.01)
*G08B 21/24* (2006.01)
*F25D 23/02* (2006.01)

(52) U.S. Cl.
CPC ..... *F25D 29/008* (2013.01); *F25D 23/02* (2013.01); *G08B 21/24* (2013.01); *F25D 2323/023* (2013.01); *F25D 2700/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,539,741 | A | 11/1970 | Voland | |
| 4,241,337 | A * | 12/1980 | Prada | F25D 29/008 200/61.69 |
| 4,771,269 | A | 9/1988 | Pasty et al. | |
| 5,070,319 | A | 12/1991 | Scuka | |
| RE33,960 | E * | 6/1992 | Neuman | F25D 29/008 200/61.62 |
| 5,887,446 | A * | 3/1999 | Lee | F25D 27/00 200/61.62 |
| 6,060,969 | A * | 5/2000 | Hufgard | H03K 17/97 324/207.21 |
| 7,232,967 | B2 * | 6/2007 | Rupp | F25D 29/008 200/61.62 |
| 2005/0200253 | A1 * | 9/2005 | Wissinger | F25D 23/028 312/405 |
| 2013/0026900 | A1 * | 1/2013 | Oh | F25D 23/02 312/401 |

* cited by examiner

*Primary Examiner* — Travis R Hunnings
(74) *Attorney, Agent, or Firm* — Price Heneveld LLP

(57) ABSTRACT

A door ajar detection system is provided. The door ajar detection system may be incorporated in a refrigerator to provide a warning when a door is left in an open position, or to prevent a false door-closed detection. The system utilizes like magnetic poles of magnets positioned opposite to each other to push one or more doors in a refrigerator into a full open position such that a door ajar detection assembly may provide an accurate reading. A latch assembly may be provided to hold the one or more doors in a closed position against the force of the like magnetic poles.

20 Claims, 13 Drawing Sheets

DOOR AJAR DETECTION SYSTEM

BACKGROUND

A door ajar detection feature helps ensure a door is kept in a closed position in an apparatus where an open door could result in the degradation or loss of contents within the apparatus, such as a refrigerator. In a refrigerator, for example, a closed door helps ensure that food is preserved and energy is conserved. When a door is ajar, the comingling of warmer air into the cooled interior can raise the interior temperature. Temperatures higher than about 44 degrees can result in rapid food spoilage as well as additional energy expenditure to re-cool the interior. In some cases, however, a door may be left only slightly ajar such that the door may appear closed and a door ajar detection feature will not register the door as being open.

SUMMARY

According to one aspect of the disclosure, a door ajar detection system for a refrigerator is provided. The door ajar detection system comprises a first magnet disposed on a refrigerator door and a second magnet disposed on a portion of the refrigerator opposite to the refrigerator door when the refrigerator door is in a closed position. Further, a north pole of the second magnet faces a north pole of the first magnet when the refrigerator door is in the closed position. The door ajar detection system also comprises a latch assembly configured to engage the refrigerator door and the portion of the refrigerator opposite to the refrigerator door. The latch assembly is configured to maintain the refrigerator door in the closed position when engaged. The door ajar detection system also includes a door ajar detection assembly coupled to the refrigerator door, where the door ajar detection assembly is configured to detect when the refrigerator door is in an open position. Additionally, control circuitry is coupled to the door ajar detection assembly, and the control circuitry is configured to activate a warning signal upon detection of the refrigerator door in the open position.

In a second aspect of the disclosure, a door ajar detection system comprises a first magnet disposed on a door and a second magnet disposed on an opposing surface, where the opposing surface is opposite from and contacts the door when the door is in a closed position. Further, a north pole of the first magnet aligns with a north pole of the second magnet when the door is in a closed position. The door ajar detection system also includes a latch assembly configured to engage the door and the opposing surface, where the latch assembly is configured to maintain the door in the closed position when engaged. Additionally, the system includes a door ajar detection assembly coupled to the door, where the door ajar detection assembly is configured to detect when the door is in an open position with respect to the opposing surface. In addition, control circuitry is coupled to the door ajar detection assembly, where the control circuitry is configured to activate a warning signal upon detection of the door in the open position.

In yet another aspect of the disclosure, a refrigerator includes a cabinet having at least one opening for access to an inner portion of the cabinet, a door for accessing the inner portion of the cabinet, and a door ajar detection system. The door ajar detection system comprises a first magnet disposed on the door and a second magnet disposed on a portion of the refrigerator opposite to the door when the door is in a closed position. A north pole of the second magnet faces a north pole of the first magnet when the door is in the closed position. The door ajar detection system further includes a latch assembly configured to engage the door and the portion of the refrigerator opposite to the door, such that the latch assembly maintains the door in the closed position when engaged. The door ajar detection system also includes a door ajar detection assembly coupled to the door, where the door ajar detection assembly is configured to detect when the refrigerator door is in an open position. Additionally, the system includes control circuitry coupled to the door ajar detection assembly, where the control circuitry is configured to activate a warning signal upon detection of the door in the open position.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description, will be better understood when read in conjunction with the appended drawings. For the purpose of illustrating the present disclosure, there are shown in the drawings, certain embodiment(s) which are presently preferred. It should be understood, however, that the disclosure is not limited to the precise arrangements and instrumentalities shown. Drawings are not necessary to scale. Certain features of the disclosure may be exaggerated in scale or shown in schematic form in the interest of clarity and conciseness.

DETAILED DESCRIPTION

The present disclosure provides a door ajar detection system. As described herein the door ajar detection system may be configured to provide a warning signal when a door is left ajar, and to also prevent a false door closed indication. In some cases, a door ajar detection assembly may be coupled to control circuitry to provide a warning signal when a door has been left ajar longer than a predetermined time period. The door jar detection system may also include provisions to prevent a false door closed indication. According to embodiments described herein the disclosed door ajar detection system may be incorporated into a number of different types of cabinets, appliances, or the like. In some cases, the disclosed door ajar detection system may be incorporated into a refrigerator to detect and provide warning that a refrigerator door has been left open. In at least one case, a door ajar detection system may be incorporated into an inner and outer door assembly in a door-within-door style refrigerator.

Figure 1:
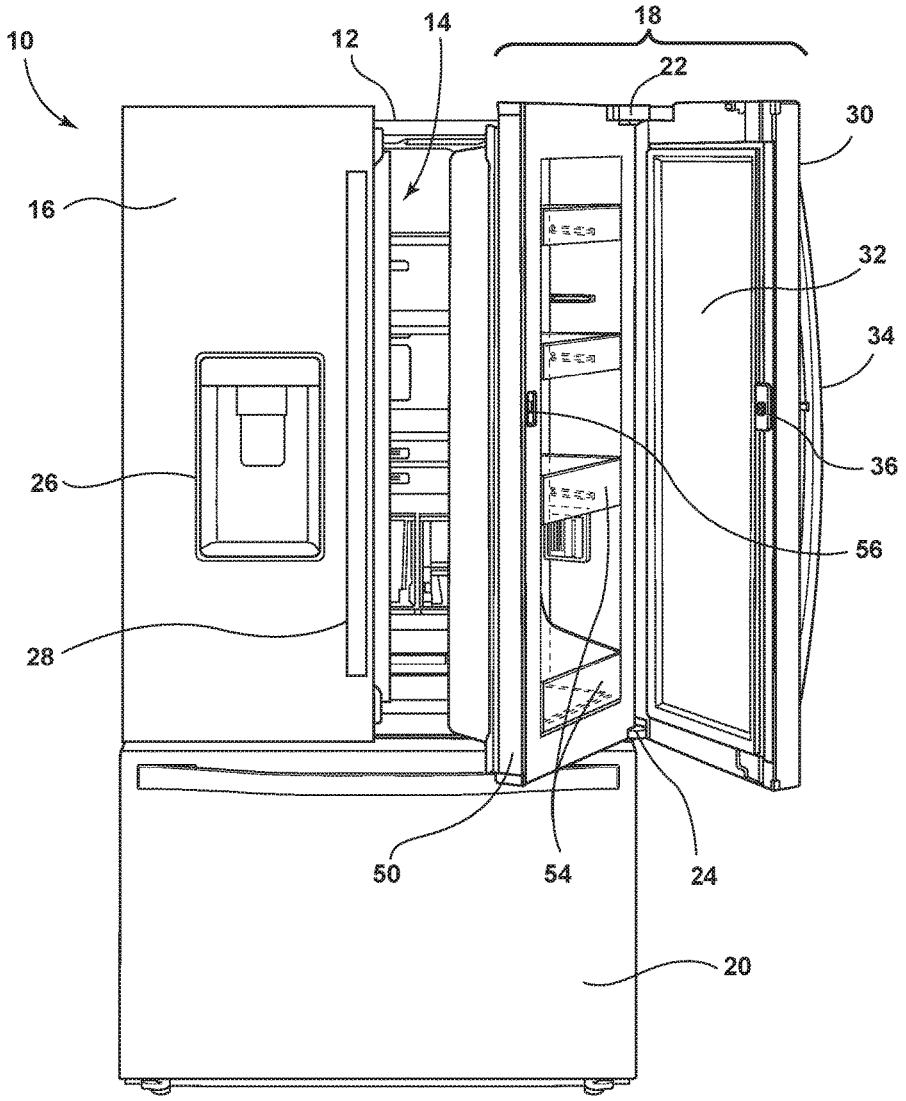
FIG. 1 is a front elevation view of a refrigerator that may incorporate a door ajar detection system, according to an embodiment of the present disclosure.
Figure 2:
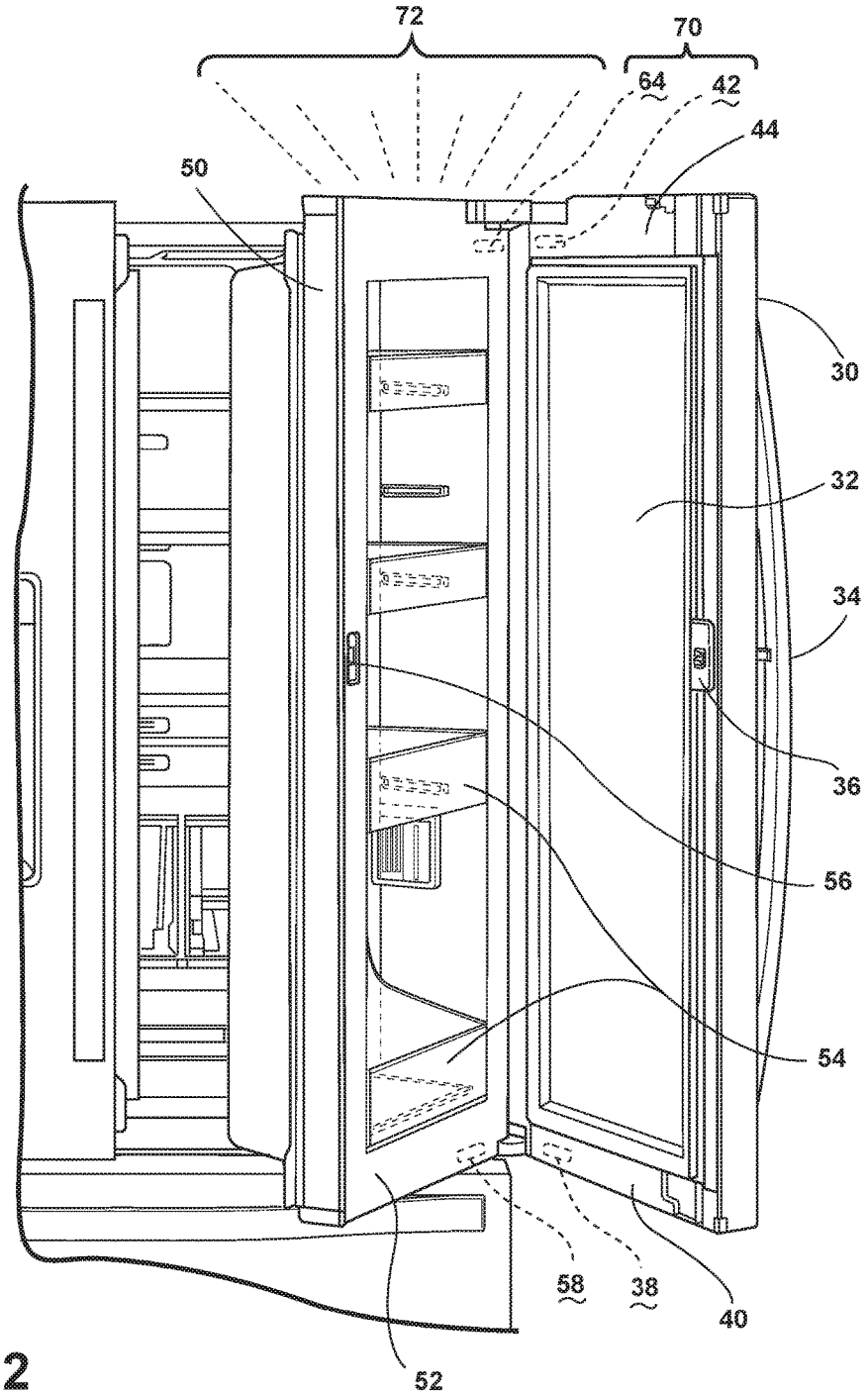
FIG. 2 is a partial front elevation view of the refrigerator, according to the embodiment of the present disclosure.

In at least one case, referring to FIGS. 1 and 2, a refrigerator 10 having a double door, or door-within-door feature, includes a door assembly 18 having an inner door 50 and an outer door 30. A detection assembly 70 is disposed on both the inner door 50 and the outer door 30, and coupled to controller 74 (FIGS. 9 and 11), to provide a warning signal 72 when the outer door 30 is left ajar. Further, to prevent a false door closed indication, an inner door magnet 58 and an outer door magnet 38 are positioned such that like poles push the doors apart when not engaged with inner door latch assembly portion 56 and outer door latch assembly portion 36. Of course the detection assembly 70 described herein may be incorporated into other areas or doors in a refrigerator, such as in a traditional one-door design, a freezer door, an internal door or other door location, or in another type of cabinet altogether, and the present disclosure will be understood to encompass all embodiments contemplated herein and not just as described with respect to any specific embodiment, such as the illustrated embodiment of refrigerator 10.

The present illustrated embodiments reside primarily in combinations of apparatus components and method steps related to a door ajar detection system. Accordingly, the apparatus components and method steps have been represented, where appropriate, by conventional symbols in the drawings, showing only those specific details that are pertinent to understanding the embodiments of the present disclosure. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. For example, an element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

FIG. 1 depicts an exemplary refrigerator 10 on which an embodiment of a door ajar detection system described herein may be used. Refrigerator 10 includes an outer frame or cabinet 12 that incorporates one or more interior cavities 14 for cooling food items. Cabinet 12 includes a top surface, a pair of side surfaces, a back surface, and bottom surface (all surfaces not shown), as would be known in the art. Refrigerator 10 may also incorporate one or more doors for accessing the one or more interior cavities 14, as would be known in the art. In the illustrated embodiment, refrigerator 10 is a French door-style refrigerator having a double door design, or in other words, a door-within-door configuration that can facilitate selective access to the one or more interior cavities 14. In the illustrated embodiment, refrigerator 10 may include a left side door 16, a right side door assembly 18, and a freezer drawer 20, for accessing the one or more interior cavities 14. Left side door 16 may include an ice/drink dispenser 26 and handle 28. Right side door assembly 18, described in more detail below, may include an outer door 30, having an outer door handle 34 and an outer door latch assembly portion 36, and an inner door 50, having an inner door latch assembly portion 56. Outer door latch assembly portion 36 and inner door latch assembly portion 56 may be engaged with each other to hold an interior surface or rear side 32 of outer door 30 closed and sealed against an outer surface or front side 52 of inner door 50. Right side door assembly 18 may also be coupled to and supported by an upper hinge assembly 22 and a lower hinge assembly 24.

As shown in the illustrated embodiment, outer door 30 may be configured such that an operator can access select portions of the interior cavity 14. For example, refrigerator 10 may be configured such that the opening of outer door 30, independently of an inner door 50, allows for selective access to one or more inner door storage areas 54, or to a shelf or drawer within interior cavity 14. Selective access to only portions of refrigerator 10 via the opening of only outer door 30 can also serve to minimize the escape of cooled air and allow more efficient operation of the refrigerator. Alternatively, when an operator wants to access the entire interior cavity 14, left side door 16 may be opened, and/or inner door 50 and outer door 30 may be opened together. Accordingly, in operation, outer door 30 and associated inner door 50 may be opened together, at the same time, or independently.

Again, it will be understood that refrigerator 10 and the embodiment of FIG. 1 is shown by way of illustration only, and it should be understood that a door ajar detection system, as further described herein may be applicable to other types of cabinets or appliances. For example, the door ajar detection system may be used on other forms of refrigerators, such as, but not limited to, French door-style refrigerators having a single pair of doors, built-in refrigerators, refrigerators having top and bottom doors, refrigerators and/or freezers having a single door, or any other cabinet or appliance cabinet configuration contemplated by a skilled artisan. Additionally, refrigerator 10 may include additional access drawers, shelves, or doors, and it should be understood that alternative configurations, and the absence or addition of one or more doors, drawers, or other access components, does not affect the spirit and scope of the present disclosure.

According to aspects described herein, refrigerator 10 may include provisions to detect and provide a warning when a refrigerator door, such as inner door 50 or outer door 30 (and collectively, door assembly 18), left side door 16, or freezer drawer 20 is left ajar. Such provisions may help to prevent the loss of cooled air from interior cavities 14, as well as the excess expenditure of energy. In some cases, refrigerator 10 may include a system to detect and alert an operator that one or more doors has been left in an open position for longer than a pre-determined period of time. In at least one case, a door ajar detection system, including the components shown and described in FIGS. 2-12, may provide a door ajar detection and warning, as well as serve to prevent a false door closed indication. It should be understood that, for simplicity, aspects of the present disclosure have been described with respect to the illustrated embodiment of refrigerator 10, and specifically with respect to the door-within-door configuration of door assembly 18. However, those skilled in the art will readily appreciate that the door ajar detection system described herein is not limited to a door-within-door configuration, nor is it limited to a refrigerator, and may be implemented in a variety of types of refrigerators as well as other types of appliances or cabinets.

FIG. 2 depicts a partial view of refrigerator 10, including door assembly 18 having a door ajar detection system, according to aspects described herein. As shown in FIG. 2, door assembly 18 may be equipped with a magnetic detection assembly 64 in inner door 50 and a detection assembly magnet 42 in outer door 30, collectively, detection assembly 70. Door assembly 18 may also include an inner door magnet 58 and an outer door magnet 38 disposed at bottom ends of inner door 50 and outer door 30, respectively, as well as an inner door latch assembly portion 56 and an outer door latch assembly portion 36. Inner door magnet 58 and outer door magnet 38 may be disposed such that like poles, e.g. the north poles of the magnets, face and repel each other to push outer door 30 away from inner door 50 when inner door latch assembly portion 56 and outer door latch assembly portion 36 are not engaged. As described in more detail below, when outer door 30 is in an open position with respect to the inner door 50 for longer than a predetermined period of time, controller 74 (described below), may cause refrigerator 10 to activate a warning signal 72, such as an alarm, light, network indication, or other warning signal contemplated in the art.

Figure 3A:
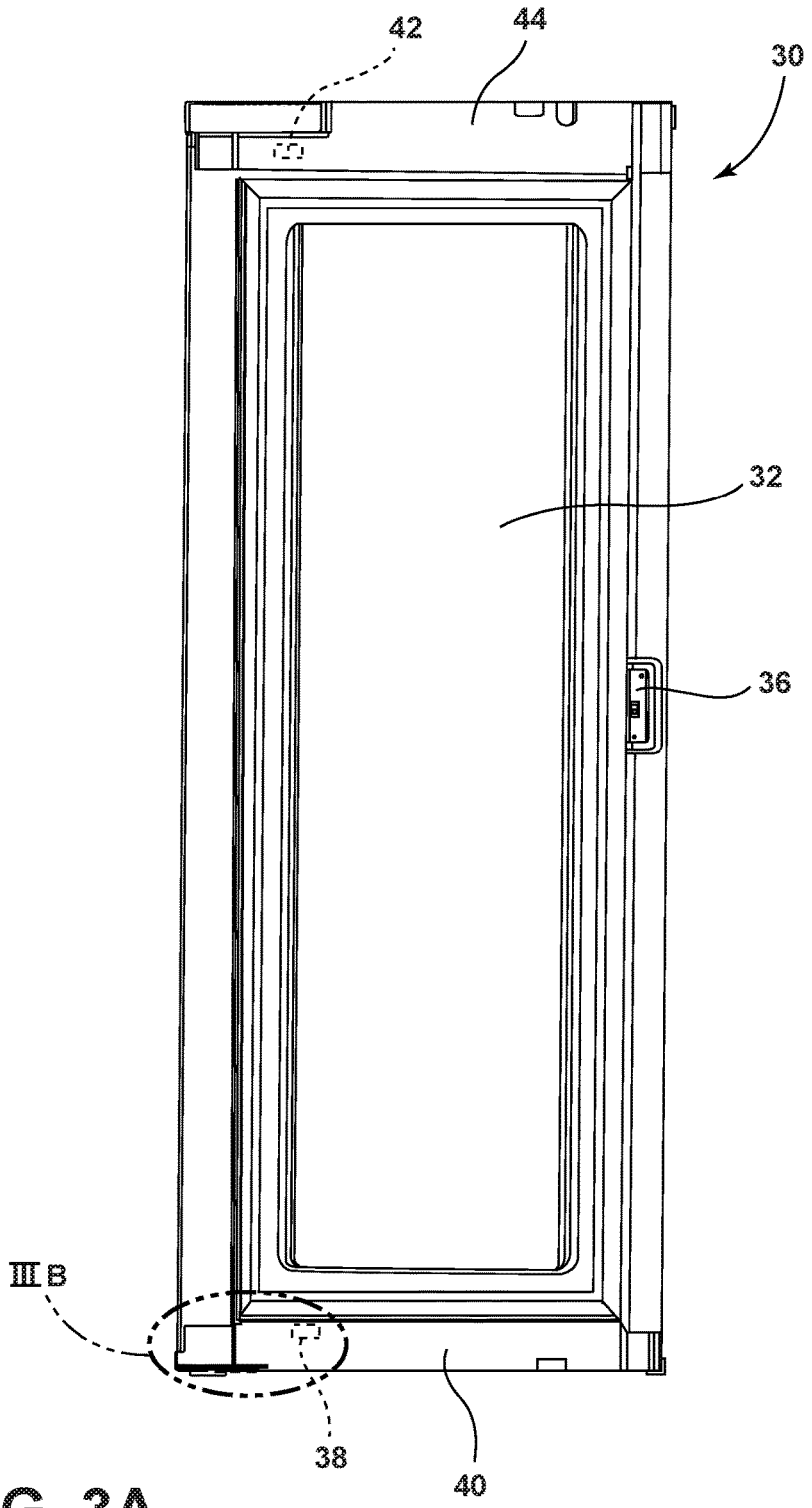
FIG. 3A is a rear elevation view of an outer door of the door assembly, according to the embodiment of the present disclosure.

FIGS. 3A, 3B, 5, and 6 depict the various portions of a door ajar detection system disposed in outer door 30 according to the illustrated embodiment. Referring to FIG. 3A, in the illustrated configuration, outer door 30 includes an outer frame 33 having a lower end cap 40 and an upper end cap 44. Outer frame 33 may also include outer door latch assembly portion 36, which may be configured to engage with inner door latch assembly portion 56, described in more detail below. Outer door 30 may also include a detection assembly magnet 42 disposed in upper end cap 44. Detection assembly magnet 42, described in more detail below, may form part of a detection assembly 70 that engages with magnet detection assembly 64 (FIGS. 9 and 10), also described in more detail below. An outer door magnet 38 may be disposed in lower end cap 40, and may be configured to interact with inner door magnet 58 disposed in inner door 50.

Figure 3B:
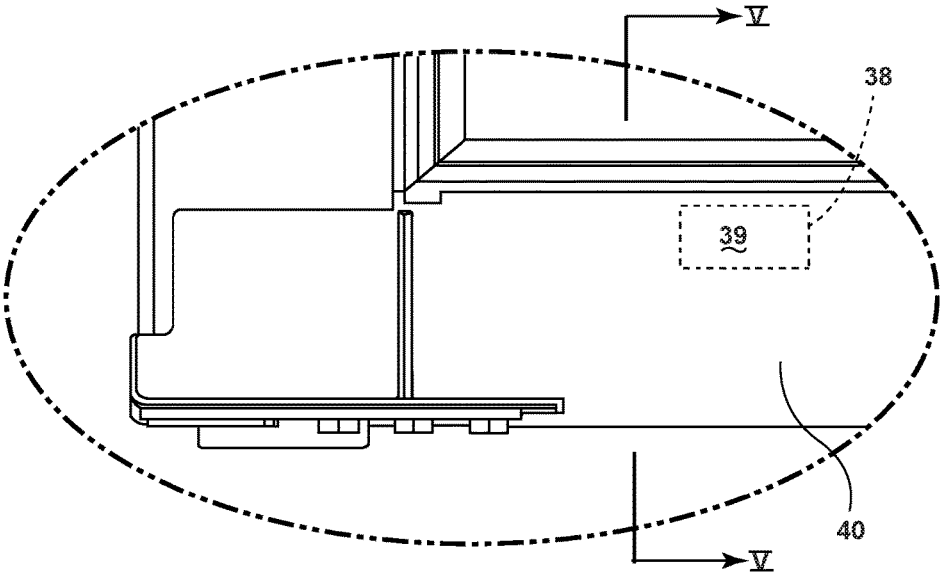
FIG. 3B is an enlarged inset of a portion of the outer door of FIG. 3A, according to the embodiment of the present disclosure.
Figure 5:
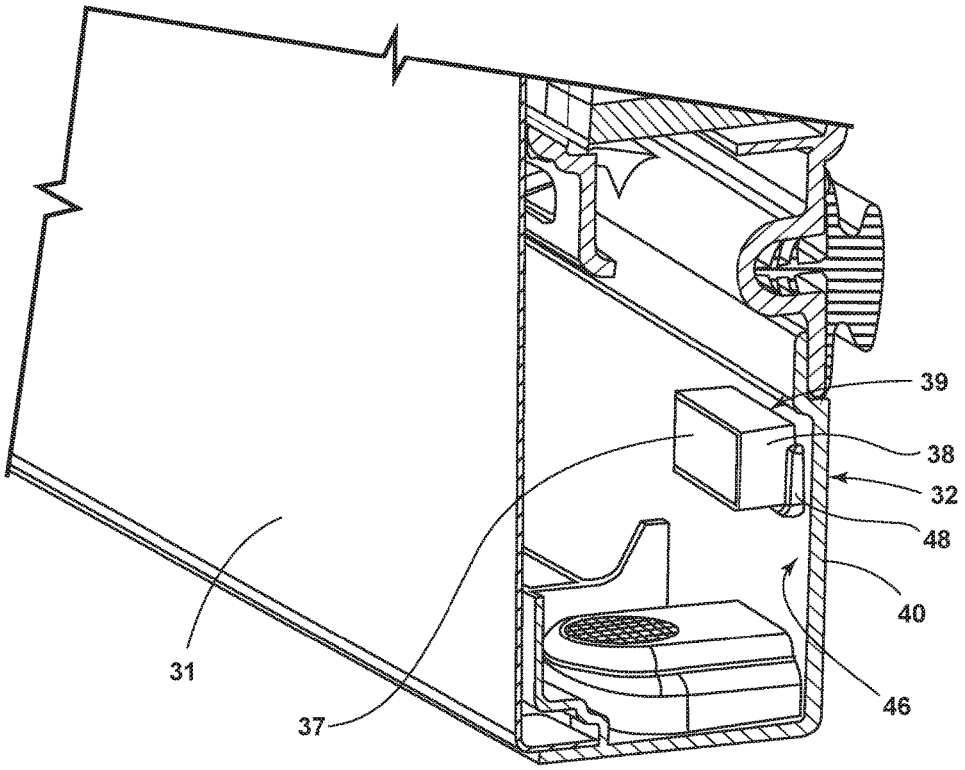
FIG. 5 is a partial cross-sectional view of a portion of the outer door of the door assembly, taken across line V in FIG. 3B, according to the embodiment of the present disclosure.
Figure 6:
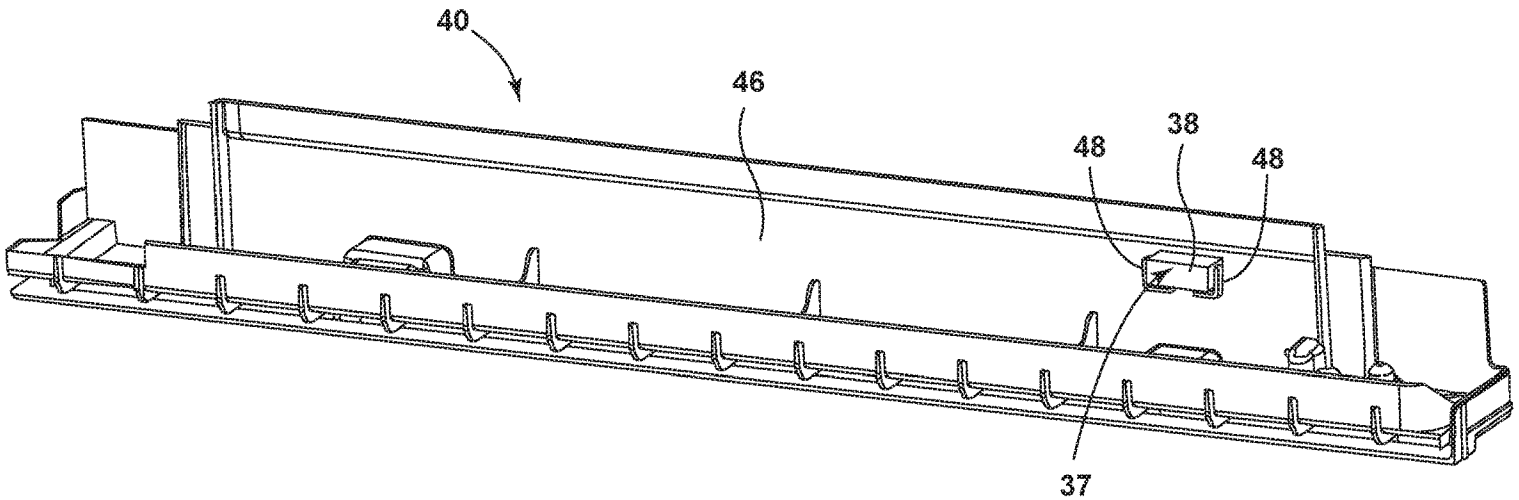
FIG. 6 is a top perspective view of a bottom end cap of the outer door of the door assembly, according to the embodiment of the present disclosure.

FIG. 3B depicts an enlarged view of a corner of lower end cap 40 having an outer door magnet 38 disposed therein. FIGS. 5 and 6 depict a cross-sectional view and top perspective view of lower end cap 40, respectively. Lower end cap 40 may be configured to couple with front side 31 and rear side 32 of outer door 30. According to the illustrated configuration, lower end cap 40 includes an interior surface 46 having a locating positioner 48 disposed thereon. Locating positioner 48 may be comprised of one or more projections on interior surface 46 and provide a position for outer door magnet 38, such that when outer door 30 and inner door 50 are in a closed position, outer door magnet 38 aligns with inner door magnet 58. As described in more detail below, outer door magnet 38 may be affixed on a hinge side of lower end cap 40 such that a north pole 39 of outer door magnet 38 faces a north pole 59 of inner door magnet 58, and a south pole 37 of outer door magnet 38 faces outward (FIG. 6). The natural repelling force of the two opposing poles forces outer door 30 and inner door 50 apart to prevent a false door-closed indication when outer door latch assembly portion 36 and inner door latch assembly portion 56 are not engaged.

Figure 4A:
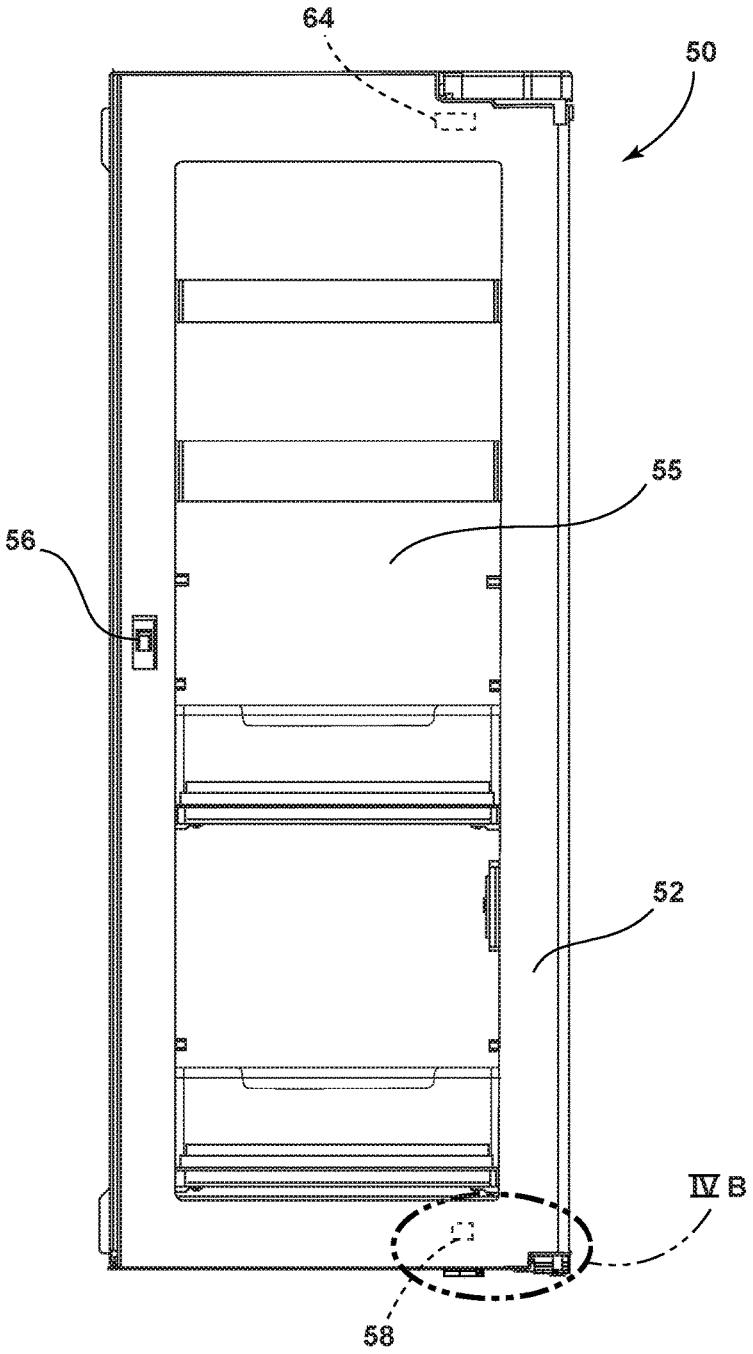
FIG. 4A is a front elevation view of an inner door of the door assembly, according to the embodiment of the present disclosure.
Figure 4B:
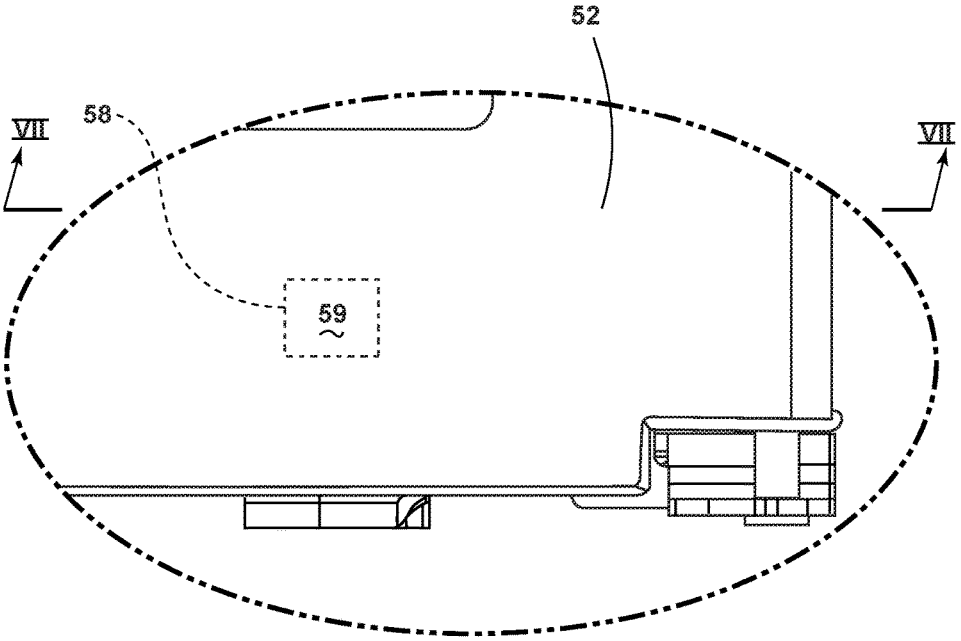
FIG. 4B is an enlarged inset of a portion of the inner door of FIG. 4A, according to the embodiment of the present disclosure.
Figure 7:
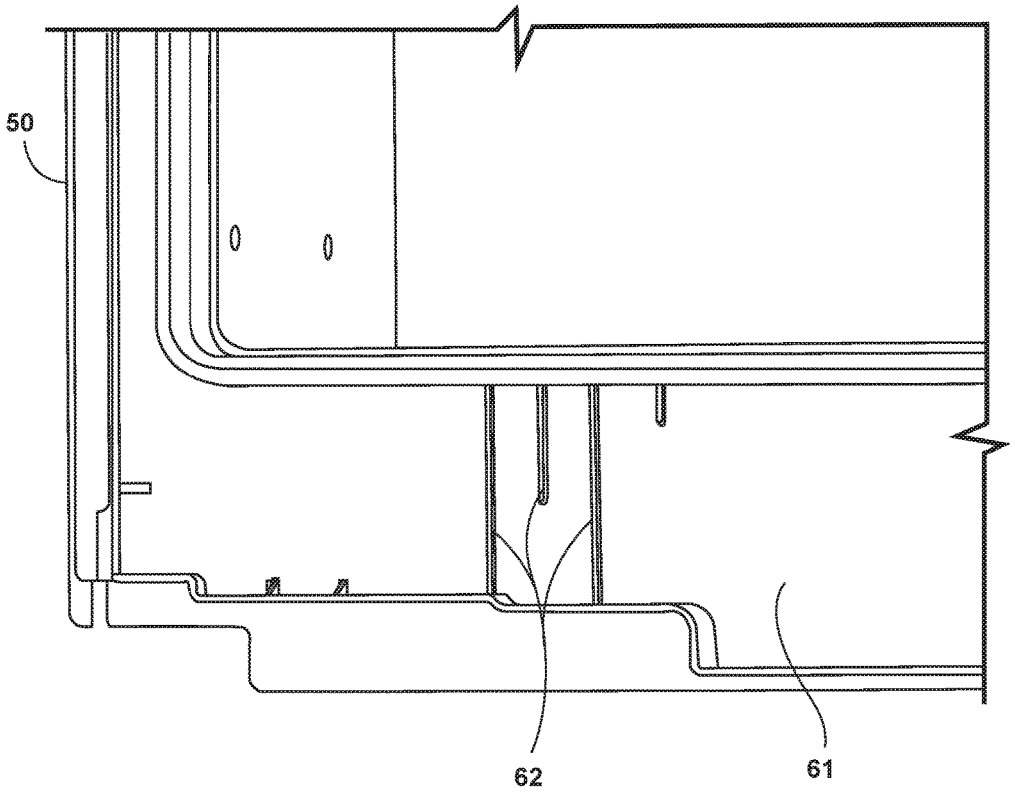
FIG. 7 is a partial front cross-sectional view of the inner door of the door assembly, according to the embodiment of the present disclosure.

FIGS. 4A, 4B and 7 depict various portions of the door ajar detection system disposed in inner door 50, according to the illustrated. Referring to FIG. 4A, in the illustrated configuration, inner door 50 includes an outer frame 53 having an open center area 55 configured with one or more inner door storage areas 54. Outer frame 53 may further include a liner portion 61 (FIG. 7), making up at least a portion of inner door 50. Outer frame 53 may also include an inner door latch assembly portion 56, which may be configured to engage with outer door latch assembly portion 36. Inner door 50 may further include a magnetic detection assembly 64, configured to interact with detection assembly magnet 42, described in more detail below, to form part of a detection assembly 70 (FIGS. 9 and 10), also described in more detail below. In a lower end of inner door liner portion 61, an inner door magnet 58 may be disposed, and may interact with outer door magnet 38 disposed in outer door 30.

FIG. 4B depicts an enlarged view of a corner of the lower end of outer frame 53 having an inner door magnet 58 disposed therein. FIG. 7 depicts a front elevation view of a lower end of inner door liner portion 61, taken across line VII in FIG. 4B. According to the illustrated configuration, inner door liner portion 61 includes a locating positioner 62 disposed thereon. Similar to locating positioner 48 for outer door 30, locating positioner 62 may be comprised of one or more projections disposed on a hinge side of inner door liner portion 61 to provide a position for inner door magnet 58, such that when outer door 30 an inner door 50 are in a closed position outer door magnet 38 aligns with inner door magnet 58. Again, as described in more detail below, inner door magnet 58 may be affixed on inner door liner portion 61 such that a north pole 59 of inner door magnet 58 faces a north pole 39 of outer door magnet 38.

Outer door 30 and inner door 50, including outer frame 33 and outer frame 53, respectively, may be configured as would be contemplated by a person in the art. For example, outer door 30 and inner door 50 may include multiple parts coupled together, including molded parts or elements, such as molded plastic materials, metal materials, or may include other configurations altogether. It will be understood that the illustrated embodiment is only one possible configuration of many embodiments, and a skilled artisan will readily recognize the many different configurations that fall in the spirit and scope of the present disclosure.

Figure 8A:
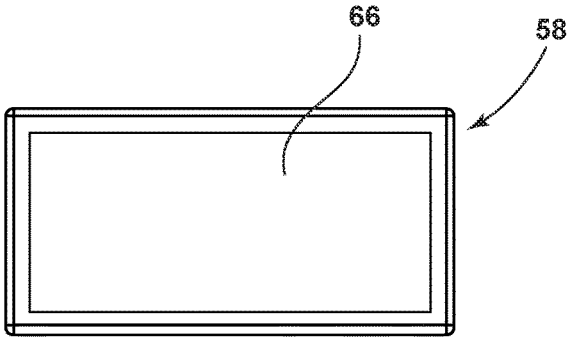
FIG. 8A is a top view of a magnet, according to the embodiment of the present disclosure.
Figure 8B:
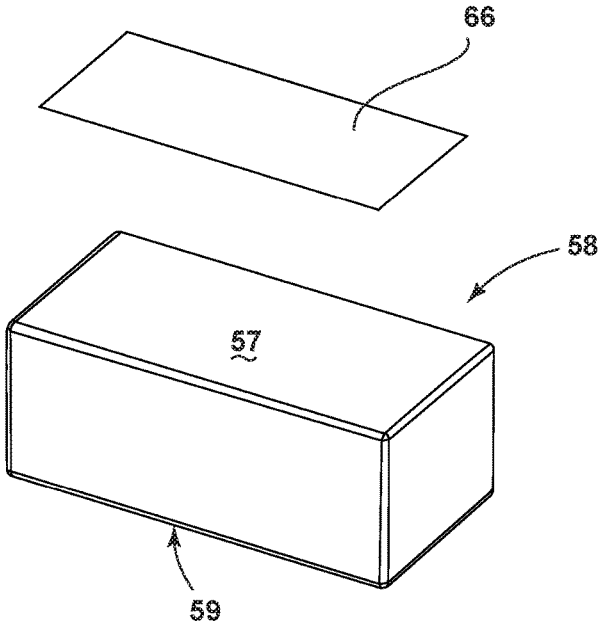
FIG. 8B is an exploded top perspective view of the magnet according to the embodiment of the present disclosure.

FIGS. 8A and 8B depict inner door magnet 58 according to an embodiment of the present disclosure. As shown in the figures, inner door magnet 58 includes a south pole 57 and a north pole 59. Inner door magnet 58 may also include an adhesive strip 60 or for coupling inner door magnet 58 to inner door liner portion 61. In the illustrated embodiment, adhesive strip 60 is adhered to south pole 57, and inner door liner portion 61 (FIG. 7) such that north pole 59 is facing toward outer door magnet 38. However, in other cases, inner door magnet 58 may be disposed in a different location or be coupled with inner door 50 according to other methods, such as by glue or mechanical fasteners. Outer door magnet 38 may be configured the same as, or similar to, inner door magnet 58, as depicted in FIGS. 8A and 8B. In the illustrated embodiment, however, the adhesive on outer door magnet may be applied to the north pole 39 (FIG. 5) for proper alignment of the north pole 39 of outer door magnet 38 with the north pole 59 of inner door magnet 58 to create the repelling action.

It will be understood, however, that the magnets may be configured in a variety of was as would be contemplated in the art. Further, those skilled in the art will understand that the various configurations and locations of inner door magnet 58 and outer door magnet 38 described herein and shown in the figures are by no means limiting to the present disclosure and are only exemplary of one embodiment.

As described above, aspects of the disclosure incorporate a door ajar detection assembly to provide an indication when a door has been left in an open position. In some cases, the door ajar detection assembly may include a proximity switch designed to activate when a door is left ajar. In at least one case, a door ajar detection system may include a magnetic reed switch in communication with a control system to provide a door ajar indication. However, in other cases, other types of switches or mechanical means may be used to indicate a door ajar status, as would be contemplated in the art.

Figure 9:
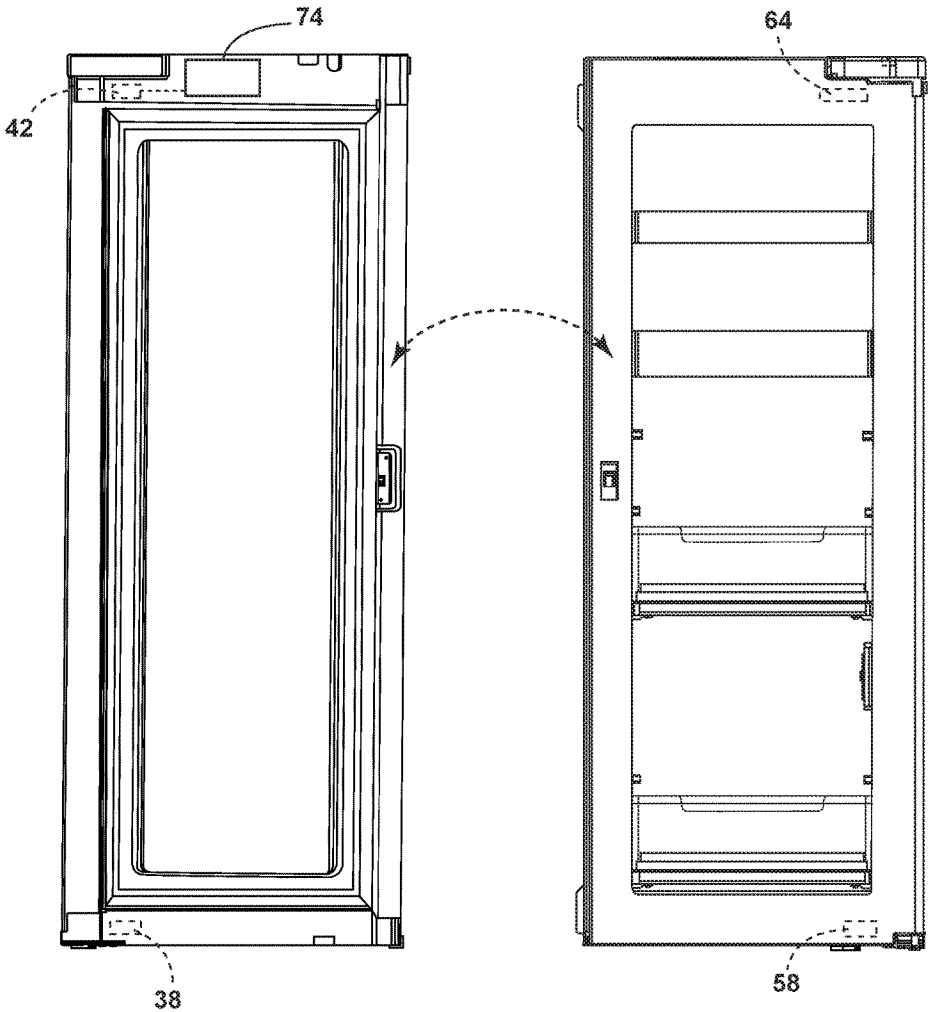
FIG. 9 is a side-by-side exploded view of the door assembly, according to the embodiment of the present disclosure.
Figure 10:
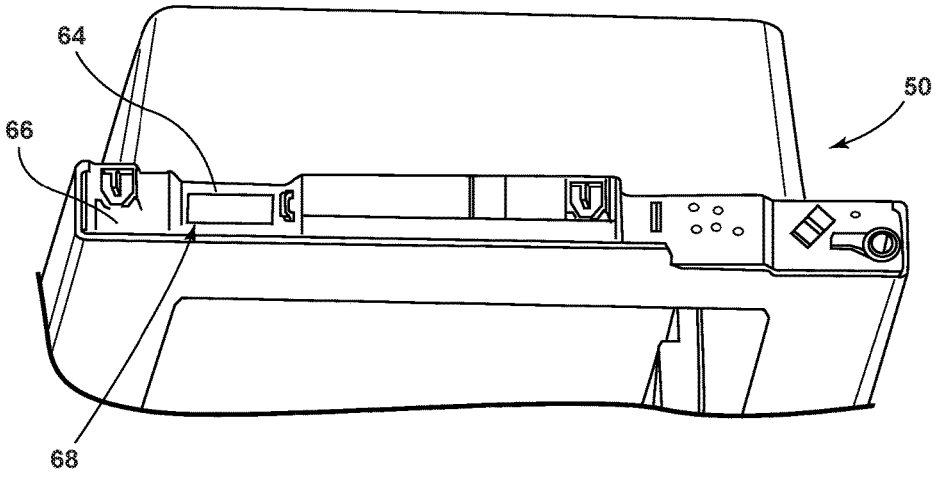
FIG. 10 is a top perspective view of the inner door of the door assembly, according to the embodiment of the present disclosure.

FIGS. 9 and 10 depict various portions of a door ajar detection assembly 70 which may be incorporated into a door ajar detection system such as described with respect to the illustrated embodiment of refrigerator 10. Specifically in the illustrated configuration, door ajar detection assembly 70 may comprise a magnetic reed switch to provide a door ajar indication to controller 74. According to the embodiment, door ajar detection assembly may include a detection assembly magnet 42 disposed in upper end cap 44 of outer door 30 and a magnet reed switch detection assembly 64 disposed in a pocket 68 of top liner surface 66 of inner door 50 (FIG. 10), opposite to and configured to line up with, as well as interact with, detection assembly magnet 42 in a closed position.

In operation, when outer door latch assembly portion 36 is engaged with inner door latch assembly portion 56, door ajar detection assembly 70 may operate to provide a door closed indication to controller 74. However, when outer door 30 is in an open position with respect to inner door 50, door ajar detection assembly 70 will operate to provide a door open indication to controller 74.

Figure 11:
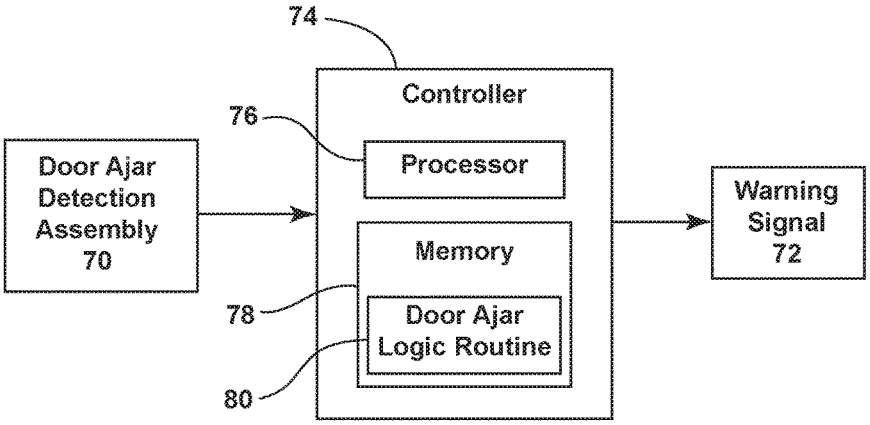
FIG. 11 is a block diagram of control circuitry, according to an embodiment of the present disclosure.

As described above, in at least some embodiments, refrigerator 10 may include control circuitry coupled to and configured to communicate with and control various components and systems of refrigerator 10. For example, FIG. 11 depicts an exemplary and simplified controller 74 which may be configured to receive inputs from various components of refrigerator 10, such as various sensors and systems, and also to control a variety of components in refrigerator 10, such as cooling components, lights, sounds, and other components as would be known by a skilled artisan. In the illustrated embodiment, for example, controller 74 may be configured to generate a warning signal 72, in the form of an alarm, light, networked message, or other type of warning signal to indicate a door ajar status.

Controller 74 may be configured as would be understood in the art, and at the very least includes a processor 76 and memory 78. Processor 76 may be configured to run various control algorithms and routines present in memory 78, such as door ajar logic routine 80. However, it will be understood and appreciated that controller 74 may include various other analog or digital circuitries that would be known in the art, and the depiction in FIG. 11 is for illustrative purposes only, and is simplified for understanding of the concepts pertinent to aspects described herein.

Controller 74 may be coupled to a variety of sensors and systems within refrigerator 10. In at least one embodiment, refrigerator 10 includes at least one door ajar detection assembly 70, as described above. As noted, however, FIG. 11 is a simplified depiction of a controller 74 associated with refrigerator 10, and it will also be appreciated that refrigerator 10 may include a variety of other known sensors and mechanisms for gathering information for controller 74, or for controlling various aspects of refrigerator 10, including the systems and processes described herein as well as those not discussed herein.

Controller 74 may be configured to receive inputs from the various sensors and systems to make decisions and control aspects or various components of refrigerator 10. In one aspect, controller 74 may receive an indication that an outer door 30 is in an open position with respect to inner door 50, as well as various parameters associated with the door ajar indication, such as an amount of time outer door 30 has been ajar. Such inputs may inform various control routines, such as door ajar logic routine 80, as described in more detail below. The various inputs may also facilitate control of components, such as the actuation of warning signal 72.

Figure 12:
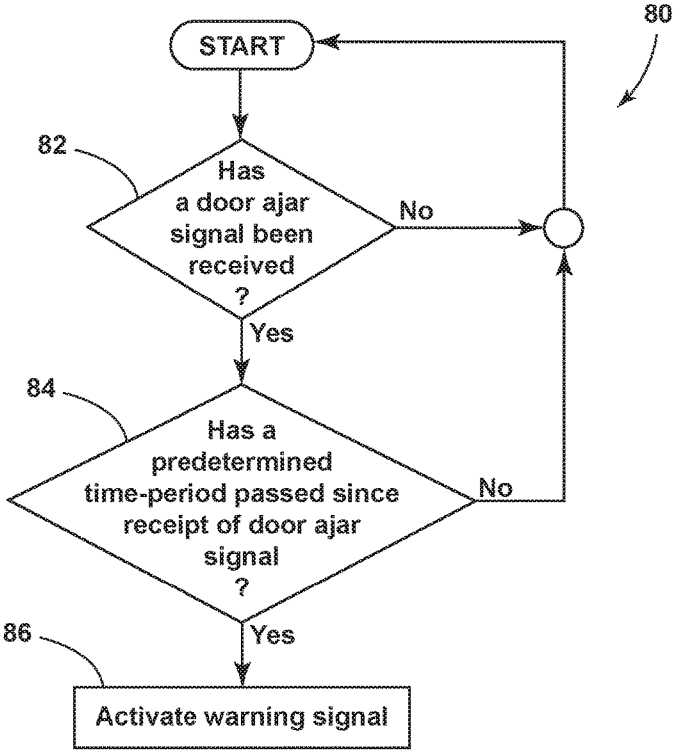
FIG. 12 is a flowchart depicting a door ajar detection system method, according to an embodiment of the present disclosure.

Referring to FIG. 12, door ajar logic routine 80 may be implemented by controller 74 according to an embodiment described herein. Specifically, at step 82, controller 74 first receives input from door ajar detection assembly 70 that outer door 30 is in an open position. At step 84, controller 74 determines if a pre-determined amount of time has passed since the door ajar indication was received. If not, the door ajar logic routine will continue looping until the outer door 30 is no longer in an open position, or until the pre-determined amount of time has passed. If, at step 84, it is determined that the pre-determined amount of time has passed since the door ajar indication was received, at step 86, warning signal 72 may be activated.

The pre-determined time period (i.e., the time that the door may remain in an open position before warning signal 72 is activated) may be set by one of skill in the art. In some cases, the pre-determined time period may be set between about 1-3 minutes, i.e. about the time it takes for an operator to peruse the items within refrigerator 10 and move one or more items out of or into refrigerator 10, or the amount of time it would take for a temperature in interior cavity 14 to degrade. In at least one case, the predetermined time period may be set at 120 seconds. In other words, if controller 74 determines that outer door 30 has been ajar for 120 seconds, controller 74 may proceed to step 86 and activate a warning signal. In other cases, the pre-determined time period may be set at 180 seconds. In still other cases, the pre-determined time period may be set longer or shorter based on other considerations that would be contemplated by a skilled artisan.

It is important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the spirit and scope of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

The invention claimed is:

1. A door ajar detection system for a refrigerator comprising:

a first magnet disposed on a refrigerator door;

a second magnet disposed on a portion of the refrigerator opposite to the refrigerator door when the refrigerator door is in a closed position, wherein a north pole of the second magnet faces a north pole of the first magnet when the refrigerator door is in the closed position;

a latch assembly configured to engage the refrigerator door and the portion of the refrigerator opposite to the refrigerator door, wherein the latch assembly is configured to maintain the refrigerator door in the closed position when engaged, and wherein a repelling force of the north poles of the first and second magnets forces the refrigerator door away from the portion of the refrigerator opposite door to the refrigerator door to prevent a false door-closed indication when the latch assembly is not engaged;

a door ajar detection assembly coupled to the refrigerator door, wherein the door ajar detection assembly is configured to detect when the refrigerator door is in an open position; and control circuitry coupled to the door ajar detection assembly, wherein the control circuitry is configured to activate a warning signal upon detection of the refrigerator door in the open position.

2. The door ajar detection system of claim 1 wherein the refrigerator is a door-within-door refrigerator, and wherein:

the refrigerator door comprises an outer refrigerator door; and the portion of the refrigerator opposite to the refrigerator door comprises an inner refrigerator door.

3. The door ajar detection system of claim 1, wherein the door ajar detection assembly comprises a reed switch assembly.

4. The door ajar detection system of claim 1, wherein the control circuitry is further configured to:

determine that the refrigerator door has been in an open position for a pre-determined time period; and activate the warning signal after the pre-determined time period.

5. The door ajar detection system of claim 4, wherein the pre-determined time period is 120 seconds.

6. The door ajar detection system of claim 4, wherein the pre-determined time period is 180 seconds.

7. The door ajar detection system of claim 2, wherein:

the first magnet is disposed on a hinge side of the outer door; and the second magnet is disposed on a hinge side of the inner door, wherein positioning the first and second magnets on the hinge side of the outer door and the inner door, respectively, decreases a force exerted by a user to overcome the repelling force of the north poles of the first and second magnets.

8. The door ajar detection system of claim 3, wherein:

a first portion of the reed switch assembly is disposed in the refrigerator door; and a second portion of the reed switch assembly is disposed in the portion of the refrigerator opposite to the refrigerator door.

9. A door ajar detection system comprising:

a first magnet disposed on a door;

a second magnet disposed on an opposing surface, wherein the opposing surface is opposite from and contacts the door when the door is in a closed position, and wherein a north pole of the first magnet aligns with a north pole of the second magnet when the door is in a closed position;

a latch assembly configured to engage the door and the opposing surface, wherein the latch assembly is configured to maintain the door in the closed position when engaged, and wherein a repelling force of the north poles of the first and second magnets forces the door away from the opposing surface to prevent a false door-closed indication when the latch assembly is not engaged;

a door ajar detection assembly coupled to the door, wherein the door ajar detection assembly is configured to detect when the door is in an open position with respect to the opposing surface; and control circuitry coupled to the door ajar detection assembly, wherein the control circuitry is configured to activate a warning signal upon detection of the door in the open position.

10. The door ajar detection system of claim 9, wherein:
the door is an outer door in a double door assembly; and
the opposing surface is an inner door of the double door assembly.

11. The door ajar detection system of claim 9, wherein the door ajar detection assembly comprises a reed switch assembly.

12. The door ajar detection system of claim 9, wherein the control circuitry is further configured to:
determine that the door has been in an open position for a pre-determined time period; and
activate the warning signal after the pre-determined time period.

13. The door ajar detection system of claim 12, wherein the pre-determined time period is 120 seconds.

14. The door ajar detection system of claim 12, wherein the pre-determined time period is 180 seconds.

15. The door ajar detection system of claim 10, wherein:
the first magnet is disposed on a hinge side of the outer door; and
the second magnet is disposed on a hinge side of the inner door.

16. The door ajar detection system of claim 11, wherein:
a first portion of the reed switch assembly is disposed on the door; and
a second portion of the reed switch assembly is disposed on the opposing surface.

17. A refrigerator, the refrigerator including a cabinet having at least one opening for access to an inner portion of the cabinet, a door for accessing the inner portion of the cabinet, and a door ajar detection system, the door ajar detection system comprising:
a first magnet disposed on the door;
a second magnet disposed on a portion of the refrigerator opposite to the door when the door is in a closed position, wherein a north pole of the second magnet faces a north pole of the first magnet when the door is in the closed position;
a latch assembly configured to engage the door and the portion of the refrigerator opposite to the door, wherein the latch assembly is configured to maintain the door in the closed position when engaged, and wherein a repelling force of the north poles of the first and second magnets forces the door away from the portion of the refrigerator opposite to the door to prevent a false door-closed indication when the latch assembly is not engaged;
a door ajar detection assembly coupled to the door, wherein the door ajar detection assembly is configured to detect when the refrigerator door is in an open position; and
control circuitry coupled to the door ajar detection assembly, wherein the control circuitry is configured to activate a warning signal upon detection of the door in the open position.

18. The refrigerator of claim 17, wherein the refrigerator is a door-within-door refrigerator, and wherein:
the door comprises an outer door; and
the portion of the refrigerator opposite to the door comprises an inner door.

19. The refrigerator of claim 17, wherein the door ajar detection assembly comprises a reed switch assembly.

20. The refrigerator of claim 17, wherein the control circuitry is further configured to:
determine that the door has been in an open position for a pre-determined time period; and
activate the warning signal after the pre-determined time period.

* * * * *